US005651450A

United States Patent [19]

Priesemuth

[11] Patent Number: 5,651,450

[45] Date of Patent: Jul. 29, 1997

[54] SWITCHES, IN PARTICULAR SWITCHES THAT CAN BE INSTALLED INTO THE INSTRUMENT PANEL OF A VEHICLE, AND A METHOD FOR MANUFACTURING A SWITCH

[76] Inventor: Wolfgang Priesemuth, Heberthal 1, 83512 Wasserburg, Germany

[21] Appl. No.: 667,181

[22] Filed: Jun. 20, 1996

Related U.S. Application Data

[63] Continuation-in-part of Ser. No. 410,361, Mar. 24, 1995, abandoned.

[30] Foreign Application Priority Data

Mar. 28, 1994 [DE] Germany ..... 44 10 771.4

[51] Int. Cl.[6] ..... H01H 9/00

[52] U.S. Cl. ..... 200/314; 200/292; 200/526

[58] Field of Search ..... 200/314, 292, 200/310, 311, 312, 313, 520, 523, 526, 530

[56] References Cited

U.S. PATENT DOCUMENTS

| | | | |
|---|---|---|---|
| 4,496,813 | 1/1985 | Fukushima | 200/314 |
| 5,252,798 | 10/1993 | Kamada | 200/314 |
| 5,373,132 | 12/1994 | Achermann et al. | 200/314 |
| 5,391,848 | 2/1995 | Murphy | 200/314 |

FOREIGN PATENT DOCUMENTS

| | | |
|---|---|---|
| 2634697 | 2/1978 | Germany . |
| 3145803 | 5/1983 | Germany . |
| 3414226 | 6/1985 | Germany . |
| 4206335 | 9/1993 | Germany . |

*Primary Examiner*—David J. Walczak
*Attorney, Agent, or Firm*—Robert W. Becker & Associates

[57] ABSTRACT

A switch has a casing and a switching member displaceably positioned in the casing and having switching contacts. An actuating element, connected to the switching member, for actuating the switch is provided. A holding member is provided. A printed circuit board with a printed circuit, connected to the switching contacts, and with electronic components is provided. The printed circuit board is mounted inside the holding member. A light source is electrically connected to the printed circuit board for illuminating the actuating element. The light source is mounted on an outer side of the holding member. The holding member together with the printed circuit board and the light source form a pre-assembled unit inserted into the switching member such that the light source faces the actuating element.

10 Claims, 2 Drawing Sheets

SWITCHES, IN PARTICULAR SWITCHES THAT CAN BE INSTALLED INTO THE INSTRUMENT PANEL OF A VEHICLE, AND A METHOD FOR MANUFACTURING A SWITCH

This application is a continuation in part of application Ser. No. 08/410,361 filed Mar. 24, 1995, now abandoned.

BACKGROUND OF THE INVENTION

The present invention relates to a switch, particularly a switch that can be installed into the instrument panel of a vehicle, and to a method for manufacturing such a switch. The switch is provided with a switching member that is slidably guided in a casing, has switching contacts, and carries an actuating element for actuating the switch. The switch is further provided with a printed board that is positioned at the switching member and has a printed circuit that is connected with the switching contacts as well as corresponding electronic components. Furthermore, the switch is provided with a light source, mounted on the switching member and connected to the printed board, for lighting the actuating element from behind.

In a known switch of the aforementioned kind (DE-OS 42 06 335) the printed board is U-shaped and carries respectively a fixture for a light source at each end of its legs. The assembly of the switching member, designed as a slide, with its U-shaped printed board at the ends of which the fixtures for the light sources to be inserted are provided, is relatively complicated. Furthermore, the printed board is subjected to stress because of this design and also because of the freely projecting light source fixtures, whereby the functioning of the printed circuits provided on the printed board are possibly affected unfavorably.

Another switch of the aforementioned kind is known from DE-AS 26 34 697. In this known switch a fixture for a lamp is mounted on the bottom of the casing; together with a protective hood, the lamp projects through the switching member designed as a slide and also through the printed board that is mounted on the switching member. This results, in addition to a complicated structure of the printed board, in a larger surface area and thus in a larger design of the entire switch. It is relatively complicated to mount the known switch since the lamp with its fixture has to be inserted into the casing and electrically connected from below. Then, the printed board provided with a hole for the lamp must to be inserted from above and connected to the contact pins projecting from the slide.

Apart from a high integration for reducing wires, a further requirement for modern switches, particularly those that are to be installed into an instrument panel of a vehicle, is that they should be designed to be as compact as possible and, at the same time, should allow for cost-efficient mounting.

Therefore, an object of the present invention is to improve a switch, as well as a method for its manufacturing, such that the aforementioned requirements are met in an advantageous way.

SUMMARY OF THE INVENTION

The switch according to the present invention is primarily characterized by:

a casing;

a switching member displaceably positioned in the casing and having switching contacts;

an actuating element, connected to the switching member, for actuating the switch;

a holding member;

a printed circuit board comprising a printed circuit connected to the switching contacts and electronic components, the printed circuit board mounted inside the holding member;

a light source, electrically connected to the printed circuit board, for illuminating the actuating element, the light source mounted on an outer side of the holding member; and the holding member together with the printed circuit board and the light source forming a pro-assembled unit inserted into the switching member such that the light source faces the actuating element.

The holding member is preferably a frame with a bottom, a cover, and two oppositely arranged sidewalls, wherein each one of the oppositely arranged sidewalls has a guide for receiving the printed circuit board.

Preferably, the switching contacts have contact pins and the bottom has recesses. The contact pins extend through the recesses for contacting the printed circuit board.

The printed circuit board has contacting surfaces for establishing electric contact, and the contact pins are connected to the printed circuit board by resting elastically prestressed on the contact surfaces.

The light source is in the form of at least one LED having leads, wherein the leads are connected with connecting wires to the printed circuit board. Preferably, the switch comprises a plurality of the LEDs connected to an upper side of the cover of the holding member.

The holding member expediently has lateral projections for snap-connecting the holding member to the switching member.

The holding member is advantageously comprised of a light-colored plastic material.

Preferably, the switching member is longitudinally slidable in the casing and has a bottom portion. The holding member has a pin connected with a first end to the bottom of the holding member and extending into the bottom portion of the switching member. A bolt is connected to a second end of the pin so as to be rotatable and axially fixed. A first and a second cam surface are positioned on opposite ends of the bolt and cooperate with the bolt so as to form a lock connection defining two different switching positions of the switch. The first cam surface is provided at an underside of the bottom of the holding member.

The inventive method for manufacturing a switch according to the present invention comprises the steps of:

providing a holding member;

providing a switching member having switching contacts with contact pins;

inserting a printed circuit board, comprising a printed circuit and electric components, into the holding member;

mounting a light source to the holding member and electrically connecting the light source to the printed circuit board;

connecting the holding member, having attached thereto the printed circuit board and the light source, to the switching member; and electrically connecting the contact pins of the switching contacts to the printed circuit board.

With the inventive construction the creation of a pre-assembled unit is achieved that—except for the still necessary connection of the printed board to the switching contacts—unites all electrical functions, including the circuit of one or more light sources for lighting the actuating element from the rear. This pre-assembled unit can be assembled in a simple manner, tested, if necessary, and then mounted into the switching member. The printed board it protected against mechanical damages since it is received in a stiff holding member, a fact that, moreover, contributes to an excellent operational reliability of the inventive switch. As a whole, the switch can be designed to be very compact and to be provided with numerous functions. The switch can be designed as a push button switch (switching member axially movable relative to the casing), as a flip switch (switching member pivotable relative to the casing), or as a rotary switch (switching member rotatable relative to the casing). The functions of the printed circuit provided on the printed board and comprising corresponding electronic components, and of the light source(s) can be of various kinds. For example, the switch, like the known aforementioned switches, can be a warning signal switch with an integrated timer relay for the turn signals of a vehicle. The switch can also relate to a defroster for windows and mirrors with an integrated relay and timer. Furthermore, it can act as a light switch for different lights with relay functions, etc.

In a preferred embodiment of the inventive switch the holding member is a frame with bottom, cover, and two oppositely arranged sidewalls with guides for the printed circuit board. The printed board can thus be mounted especially easily, on the one hand, and, on the other hand, is received very safely and protected from all sides.

According to another embodiment, the bottom of the holding member designed as a frame has recesses through which the contact pins of the switching contacts extend.

By providing the printed board with contacting surfaces for the contact pins, it is achieved that a contact to the printed board is made automatically on inserting the holding member into the switching member.

A secure hold of the holding member at the switching member is achieved in a simple manner by providing the holding member with lateral projections for snap-connecting it to the switching member.

Advantageous details of the device include the use of LEDs or a light-colored plastic for the holding member for lighting the actuating element from behind. When producing the holding member from light-colored plastic reflectors are obsolete, and when using a plurality of LEDs different light symbols are actuated depending on the respective position of the switch or the switching of the printed circuit in dependence with the switching contacts.

Another embodiment of the inventive switch corresponds to the switch of DE 31 45 803 C2 with respect to the lock mechanism for the positions of the switching member. This lock mechanism can also be applied to a switch of the aforementioned kind according to DE-OS 42 06 335. According to the invention, the holding member takes over functions of the lock mechanism.

The inventive method is extremely simple, can be performed manually or automatically, and is inexpensive.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

The switch is composed of four construction units: a casing 20 in which a switching member 40 is guided to be longitudinally movable. The switching member 40, for example, is connected to an actuating element 60 by a snap connection and receives a holding member 80.

Apart from the holding member 80, the switch corresponds in its basic structure to the switch according to DE-OS 42 06 335, the disclosure of which is herewith incorporated by reference; therefore it will be described only briefly.

Figure 1:
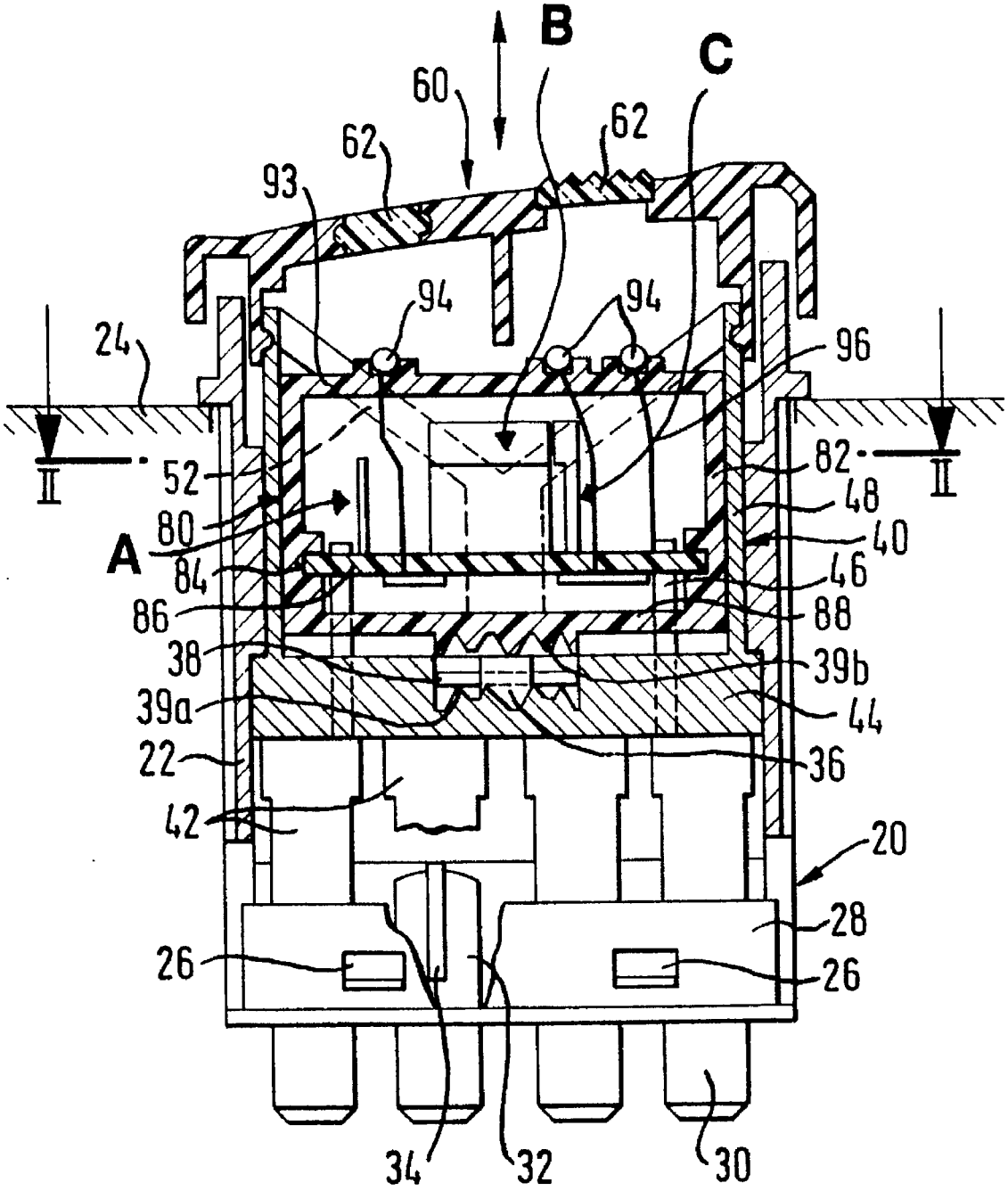
FIG. 1 illustrates a side view of a switch, partly in cross-section.

The switching member 40 is displaceable upwardly and downwardly as indicated by the arrow in FIG. 1. Thus, the switching contacts 42 which are fixedly connected to the bottom 44 of the switching member 40 move with the switching member 40 when the actuating element is depressed or released. Furthermore, it should be noted that there are two sets of contacts: leads 32 at the bottom 28 that extend into the housing (please note that according to the cutaway portion of FIG. 1 these leads 32 end in the housing and are not identical to the switching contacts 42 that are fastened to the bottom 44) and the switching contacts 42 that penetrate the bottom 44 and end inside the holding member 80 in the form of contact pins 46. The contacts 42 can thus be moved up and down by depressing or releasing the actuating element 60 and the switch member 40. The cam-shaped plastic projections 34 of the leads 32 are positioned such that depending on the switching position (release or depressed position) the switching contacts 42 are in contact or not in contact with the leads 32.

Figure 2:
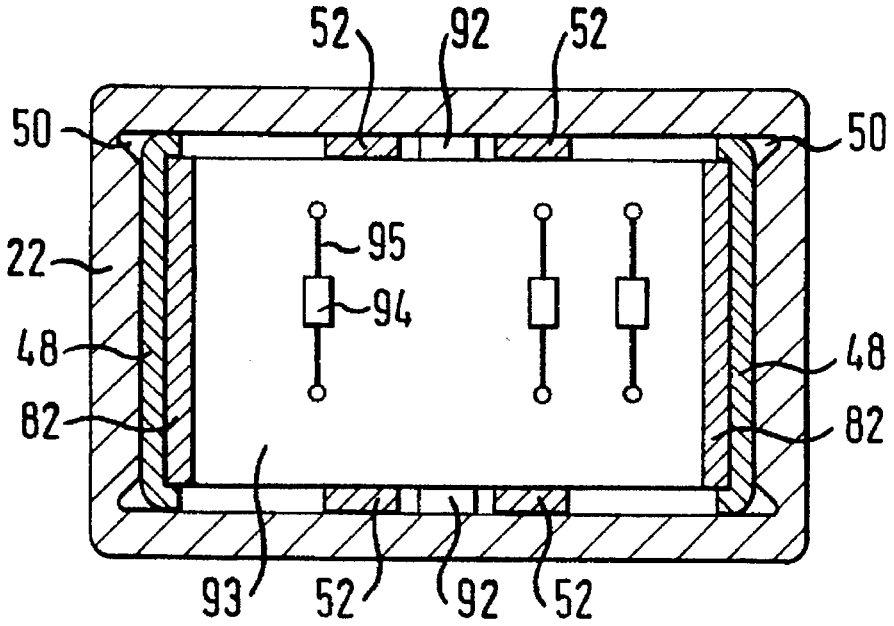
FIG. 2 illustrates a sectional view of the switch according to FIG. 1, along line II—II of FIG. 1.

The casing 20 is provided with an interior housing 22 that is received in an opening of a switchboard 24. In its lower section the casing 20 is provided with retaining holes 26 by which it is snap-connected to corresponding projecting portions of a bottom member 28. From the bottom member 28, contacts 30 project for plugging the switch into a corresponding socket of a vehicle. It is understood that the contacts 30 can be protected by a mantle embodied as one piece with the bottom member 28. The contacts 30 project through the bottom member 28 into the casing 20 and form leads 32 with plastic cam-shaped projections 34, which determine, according to the respective position of the switch, whether an electrical connection exists between the switching contacts 42 and the leads 32. The switching contacts 42 protrude from the bottom portion 44 of the switching member 40. They penetrate it and end in contact pins 46. The switching member 40 has two sidewalls 48 which are guided in the interior housing 22 by projections 50 (FIG. 2). The sidewalls 48 are connected to each other via Y-shaped stays 52 so that the switching member 40 is a stiff member in itself at which the contact pins 46 are easily accessible.

Figure 3:
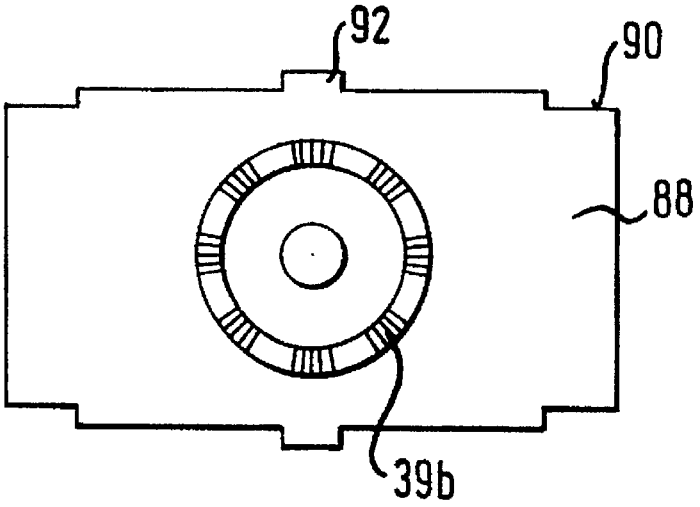
FIG. 3 illustrates a holding member, viewed from below.

The holding member 80 is designed as a closed, rectangular frame, the sidewalls 82 of which are provided with guides 84 at their opposed inner sides. Into the guides 84 a printed board 86 is inserted that carries a printed circuit and electronic, respectively, electrical components A, B, C. The bottom 88 (FIG. 3) of the holding member 80 is provided with recesses 90 and projections 92. The purpose of the recesses 90 is to receive the contact pins 46 which are soldered to corresponding connections of the printed board 86 or rest elastically on it in case of a corresponding embodiment. The purpose of the projections 92 is to snap-connect the holding member 80 and the switching member 40 at the base of the Y-shaped stays 52.

The cover 93 of the holding member 80 that is completely composed of a light-colored plastic has an upper surface facing the actuating element 60. Projections are provided on this upper surface for receiving light-emitting diodes 94. Through the cover 93 (FIG. 3) leads 95 of the light-emitting diodes (LEDs) 94 extend and are soldered to connecting wires 96 by which the leads 95 are connected to the printed circuit of the printed board 86. It is understood that the connecting wires 96 can be omitted if the leads 95 are provided with a sufficient length.

The light-emitting diodes 94 are arranged on the cover 93, respectively, the upper surface thereof such that they specifically light the translucent portions 62 that are provided in the actuating element 60 and that display the respective functional symbols.

The function of the printed circuit is known per se and reference can be made to DE-OS 42 96 335, for example.

The mechanism of the defined slidability of the switching member 40 relative to the casing 20 corresponds to the one of DE 31 45 803 C2 and will be explained briefly in the following. Reference DE 31 45 803, the disclosure of which is herewith incorporated by reference, shows a pin 21 supported at the bottom 2 of the housing 1. The pin 21 has a bolt 23 extending diametrically through it at the upper end (see prior art FIG. 5). The pin 21 with the bolt 23 is rotatable within a guide path defined between the upper and lower parts 13, 14 (a developed view is shown in FIG. 8, showing the axial staggering of the depressions at 0° and 90° defining the "on" ("ein") and "off" ("aus") positions at the guide surfaces of the guide path). Thus, a depression of the switch against the force of the spring 22 will move the bolt 23 along the surfaces of the guide path. When the switch is depressed with bolt 23 in the "off" position (see FIG. 8 at 0°), the bolt will be forced along the guide path of 13 until it reaches the upper end and upon release of the switch is guided along the surface of 14 until it reaches the depression at the 90° location (the "on" position). Based on the position of the bolt 23 within the guide path, the contact 27 (see prior art FIG. 1) rests at the cam-shaped projection of the contact 5 or directly at the contact 5. The same principle is used in the present invention, i.e., the depressions between the teeth of the cam surfaces 39*a*, 39*b* define the various switching positions. In the present invention, the pin 36 is connected to the bottom 28. The 28 pin 36 is mounted that penetrates the bottom portion 44 of the switching member 40 and supports a bolt 38 at its end so as to be rotatable but axially fixed. The bolt 38 extends transversely through the pin 36 and cooperates with a cam surface 39*a* provided with teeth of different size within the bottom 44 and with a toothed cam surface 39*b* (FIG. 3) provided at the bottom surface of the holding member 80. A not illustrated compression spring acts between the bottom member 28 of the casing 20 and the bottom 44 of the switching member 40. When the switch is depressed, the switching member 40 is moved downwardly thereby compressing the spring arranged between the bottom 28 and the bottom 44. The downward movement displaces the cam surface 39*b* downwardly so that the bolt 38 comes into contact with the cam surface 39*b* along which it is guided until it reaches the next switching position when the switching member is released.

The assembly of the described switch is carried out as follows:

For mounting the bottom 28 to the switching member 40, the pin 36, which is fixed to the bottom 28, is inserted through the bottom 44 of the switching member 40 and then the bolt 38 is fastened through the top of the pin 36. This effects the connection of the bottom 28 and the switching member 40. Subsequently, the holding member 80 can be inserted.

Thus, the bottom member 28 with the contacts 30 and the leads 32 is connected to the switching member 40 by the pin 36 and the bolt 38 so that the switching function of the switch is defined which is based on the relative motion of the two parts.

Into the holding member 80 the finished printed board 86, if necessary, provided with the connecting wires 96, is inserted. The light-emitting diodes 94 located at the upper surface of the holding member 80 are connected to the printed board 86, if necessary, by the connecting wires 96. A pre-assembled structural component is thus created that protectively receives electromechanical or larger-structured parts of the circuit between the printed board 86 and the cover 93 and receives the rest of the printed circuit with further electronic components, for example, an integrated circuit, between the printed board 86 and the cover 93, in a securely protected manner. The entire structural unit is inserted into the switching member 40 from above and snap-connected therein. The lock positions of the switch are given by the functionally arranged cam surfaces 39*b* at the bottom surface of the holding member 80.

The contact pins 46 are soldered to the connections provided for them on the printed board 86 if they are not designed such that they make contact automatically when the holding member 80 is inserted.

Subsequently, the interior housing 22 is placed onto the bottom member 28 and snap-connected therewith. Then, the actuating element 60 is slipped onto the switching member 40.

Having an extremely compact structure and a high functional reliability, the switch is now ready to be plugged into the switchboard, respectively, instrument panel 24 of a vehicle or into any other opening provided.

The present invention is, of course, in no way restricted to the specific disclosure of the specification, examples, and drawings, but also encompasses any modifications within the scope of the appended claims.

What I claim is:

1. A switch comprising:

a casing;

a switching member displaceably positioned in said casing and having switching contacts;

an actuating element, connected to said switching member, for actuating said switch;

a holding member;

a printed circuit board comprising a printed circuit connected to said switching contacts and electronic components, said printed circuit board mounted inside said holding member;

a light source, electrically connected to said printed circuit board, for illuminating said actuating element, said light source mounted on an outer side of said holding member; and said holding member together with said printed circuit board and said light source forming a pre-assembled unit inserted into said switching member so as to be displaceable with said switching member, wherein said light source faces said actuating element.

2. A switch according to claim 1, wherein said holding member is a frame with a bottom, a cover and two oppositely arranged sidewalls, wherein each one of said oppositely arranged sidewalls has a guide for receiving said printed circuit board.

3. A switch according to claim 2, wherein:

said switching contacts have contact pins;

said bottom has recesses; and said contact pins extend through said recesses for contacting said printed circuit board.

4. A switch according to claim 3, wherein said printed circuit board has contacting surfaces for establishing electric contact and wherein said contact pins are connected to said printed circuit board by resting elastically prestressed on said contact surfaces.

5. A switch according to claim 2, wherein said light source is at least one LED having leads, wherein said leads are connected with connecting wires to said printed circuit board.

6. A switch according to claim 5, comprising a plurality of said LEDs connected to an upper side of said cover of said holding member.

7. A switch according to claim 1, wherein said holding member has lateral projections for snap-connecting said holding member to said switching member.

8. A switch according to claim 1, wherein said holding member is comprised of a light-colored plastic material.

9. A switch according to claim 1, wherein:

said switching member is longitudinally slidable in said casing and has a bottom portion;

said holding member has a pin connected with a first end to said bottom of said holding member and extending into said bottom portion of said switching member;

a bolt connected to a second end of said pin so as to be rotatable and axially fixed;

a first and a second cam surface positioned on opposite ends of said bolt and cooperating with said bolt so as to form a lock connection defining two different switching positions of said switch;

said first cam surface provided at an underside of said bottom of said holding member.

10. A method for manufacturing a switch, said switch comprising a casing; a switching member displaceably positioned in said casing and having switching contacts; an actuating element, connected to said switching member, for actuating said switch; a holding member; a printed circuit board comprising a printed circuit connected to said switching contacts and electronic components, said printed circuit board mounted inside said holding member; a light source, electrically connected to said printed circuit board, for illuminating said actuating element, said light source mounted on an outer side of said holding member; and said holding member together with said printed circuit board and said light source forming a pre-assembled unit inserted into said switching member such that said light source faces said actuating element; said method comprising the steps of:

providing a holding member;

providing a switching member having switching contacts with contact pins;

inserting a printed circuit board, comprising a printed circuit and electric components, into the holding member;

mounting a light source to the holding member and electrically connecting the light source to said printed circuit board;

connecting the holding member, having attached thereto the printed circuit board and the light source, to the switching member; and electrically connecting the contact pins of the switching contacts to the printed circuit board.

* * * * *